US008763948B1

(12) United States Patent
Holowaty

(10) Patent No.: US 8,763,948 B1
(45) Date of Patent: Jul. 1, 2014

(54) ELECTRONIC TOILET TISSUE DISPENSER

(76) Inventor: Esmonde Holowaty, Fort McMurray (CA)

( * ) Notice: Subject to any disclaimer, the term of this patent is extended or adjusted under 35 U.S.C. 154(b) by 589 days.

(21) Appl. No.: 13/095,468

(22) Filed: Apr. 27, 2011

Related U.S. Application Data

(60) Provisional application No. 61/328,474, filed on Apr. 27, 2010.

(51) Int. Cl.
*B65H 63/08* (2006.01)

(52) U.S. Cl.
USPC ..... 242/564.4; 242/563.2; 242/565

(58) Field of Classification Search
USPC ..... 242/563, 563.1, 563.2, 564, 564.1, 242/564.3, 564.4, 565
See application file for complete search history.

(56) References Cited

U.S. PATENT DOCUMENTS

| | | | | | |
|---|---|---|---|---|---|
| 3,167,368 | A | * | 1/1965 | Rozlog et al. | 242/564.3 |
| 3,210,139 | A | * | 10/1965 | Ciervo | 242/564.4 |
| 3,301,617 | A | * | 1/1967 | Goodwin et al. | 242/564.4 |
| 3,963,190 | A | | 6/1976 | Wilson | |
| 4,071,200 | A | | 1/1978 | Stone | |
| 4,119,255 | A | * | 10/1978 | D'Angelo | 226/136 |
| 4,363,454 | A | | 12/1982 | Mohar | |
| 4,662,577 | A | | 5/1987 | Lewis | |
| 4,721,265 | A | | 1/1988 | Hawkins | |
| 5,312,021 | A | * | 5/1994 | Nelson | 222/183 |
| 6,112,631 | A | * | 9/2000 | VanAlstine | 83/589 |
| 6,179,243 | B1 | * | 1/2001 | Granger | 242/564.5 |
| 6,474,209 | B1 | | 11/2002 | Granger | |
| 6,883,787 | B2 | * | 4/2005 | Allen | 261/30 |
| 7,318,949 | B2 | * | 1/2008 | Shadrach, III | 427/424 |
| 7,354,015 | B2 | | 4/2008 | Byrd | |
| 7,370,824 | B1 | | 5/2008 | Osborne | |
| 2013/0105614 | A1 | * | 5/2013 | Hjort et al. | 242/564.5 |

* cited by examiner

*Primary Examiner* — William A Rivera
(74) *Attorney, Agent, or Firm* — Robert C. Montgomery; Montgomery Patent & Design

(57) ABSTRACT

A toilet tissue dispensing apparatus which automatically dispenses a predetermined length of toilet tissue is herein described. A toilet tissue roll is contained within an enclosure and is fed from a front panel through a small slot. A motion sensor detects a user's hand and automatically initiates the feeding of the tissue. A digital readout displays an approximate number of sheets remaining on the roll. When a predetermined minimum number of sheets are left, the digital display begins to flash, thereby indicating the need to replenish the tissue. The dispenser is installed in a recessed manner within a bathroom wall capable of being accessed in a drawer-like manner for tissue roll replacement.

9 Claims, 6 Drawing Sheets

10

ELECTRONIC TOILET TISSUE DISPENSER

RELATED APPLICATIONS

The present invention was first described in and claims the benefit of U.S. Provisional Application No. 61/328,474 filed Apr. 27, 2010, the entire disclosure of which is incorporated herein by reference.

FIELD OF THE INVENTION

The present invention relates generally to electronic toilet paper dispensers, and in particular, to an automatically dispensing electronic toilet paper dispenser.

BACKGROUND OF THE INVENTION

Rolls of toilet paper and an associated dispenser are nearly ubiquitous fixtures anywhere there is a toilet. Toilet paper is usually dispensed from a horizontally-placed toilet paper holder located close to the toilet for easy access.

While such dispensers are indubitably functional, they have a number of drawbacks. First, the freewheeling design often results in accidentally dispensing more toilet paper than was desired, which results in waste. If an attempt is made to re-roll the paper, it becomes an unsightly mess and can be unsanitary.

Moreover, elderly or disabled persons may suffer from reduced manual dexterity that inhibits their ability to unroll the toilet paper.

Various attempts have been made to provide powered toilet paper dispensers. Examples of these attempts can be seen by reference to several U.S. patents. U.S. Pat. No. 4,071,200, issued in the name of Stone, describes a toilet tissue dispensing assembly attachable to an existing wall-mounted toilet tissue dispenser. The Stone apparatus further includes a motor-driven gear assembly.

U.S. Pat. No. 4,721,265, issued in the name of Hawkins, describes an electronic toilet tissue dispenser with a continuous dispensing function actuated by placing your hand in front of a sensor.

U.S. Pat. No. 5,312,021, issued in the name of Nelson, describes a combined rolled paper product and liquid fluid dispenser with a button-actuated automatic toilet paper unrolling mechanism.

U.S. Pat. No. 7,354,015, issued in the name of Byrd et al., describes a hands-free electric paper towel dispenser with a sensing mechanism actuated by placing an object, such as a hand, adjacent to the front cover.

While these apparatuses fulfill their respective, particular objectives, each of these references suffer from one (1) or more of the aforementioned disadvantages. Many such apparatus are difficult to refill. Furthermore, many such apparatus contain or partially contain the toilet paper roll which makes it difficult to determine when a roll is nearly expended. Also, many such apparatuses are unnecessarily difficult to operate, either in terms of complexity or physical requirements. Accordingly, there exists a need for an electronic toilet paper dispenser without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an electronic toilet paper dispenser which is simple to evaluate, operate, and refill. Thus, the object of the present invention is to solve the aforementioned disadvantages and provide for this need.

To achieve the above objectives, it is an object of the present invention to provide a recessed, wall-mounted electronic toilet tissue dispenser that dispenses toilet tissue automatically and without requiring physical actuation. The apparatus includes a housing for the toilet tissue and a motion sensor which actuates a drive roller to dispense a predetermined amount of the toilet tissue through the front of the housing when triggered.

Another object of the present invention is to provide ready access to the interior of the apparatus in order to replace the toilet tissue roll. The apparatus includes a pair of opposing tracks mounted within a wall cavity. The tracks support the housing and allow a user to easily slide the housing outwardly from the wall cavity in order to access the tissue roll. The tissue roll is retained on a common spring-loaded cylindrical tissue roll holder within the housing.

Yet still another object of the present invention is to provide a latch on a face plate of the housing which attaches to the bathroom wall so that the apparatus does not accidently open between refills. The latch is readily released by pressing a push button on an edge of the face plate.

Yet still another object of the present invention is to automatically dispense toilet paper when the motion sensor is triggered. The motion sensor actuates a motor located within the housing when drives a drive arm and drive roller. The drive arm provides a spring-loaded force against the drive roller and a lower portion of the roll of toilet tissue, causing the roll of toilet tissue to rotate by a predetermined amount and consequently dispenser a predetermined amount of toilet tissue through the face plate.

Yet still another object of the present invention is to provide a display on an exterior surface of the face plate which provides a numerical display of the approximate remaining number of sheets of tissue on the roll. The display is a digital display which is operated by a control box which includes a software counter that monitors the accumulative cycling of the motor to calculate the total amount of tissue dispensed, and which flashes when the amount of toilet paper remaining is low. The digital display includes a reset button that allows the display and software counter to be reset when a toilet tissue roll is replaced.

Yet still another object of the present invention is to provide a constant, uninterrupted power source by hardwiring the electrical and electronic components of the apparatus into an available 110-volt electrical power supply within the bathroom wall.

Yet still another object of the present invention is to provide a method of utilizing the device that provides a unique means of installing the apparatus in a wall, placing a roll of tissue paper in the housing, passing a hand through the sensor beam one (1) or more times until a desired length of toilet tissue is dispensed, replenishing the toilet tissue by pressing the release button to unlatch the face plate latch, resetting the display counter, and benefiting from automatic and hands-free dispensing of toilet tissue.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | electronic toilet tissue dispenser |
| 20 | face plate |
| 22 | dispensing slot |
| 30 | release button |
| 32 | face plate latch |
| 33 | tissue hub |
| 34 | tissue chute |
| 35 | housing |
| 36 | roll holder |
| 37 | first track |
| 38 | second track |
| 39 | access cover |
| 40 | latch |
| 50 | sensor enclosure |
| 51 | sensor |
| 52 | sensor beam |
| 56 | digital display |
| 57 | reset button |
| 80 | motor |
| 81 | first belt roller |
| 82 | motor bracket |
| 83 | second belt roller |
| 84 | drive roller |
| 86 | drive arm |
| 87 | drive belt |
| 88 | torsion spring |
| 90 | control box |
| 91 | drive arm mounting bracket |
| 92 | internal wiring |
| 94 | electrical supply wiring |
| 100 | toilet |
| 110 | bathroom wall |
| 115 | wall cavity |
| 120 | toilet tissue |

DETAILED DESCRIPTION OF THE PREFERRED EMBODIMENT

In accordance with the invention, the best mode is presented in terms of a preferred embodiment, herein depicted within FIGS. 1 through 6 However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Figure 1:
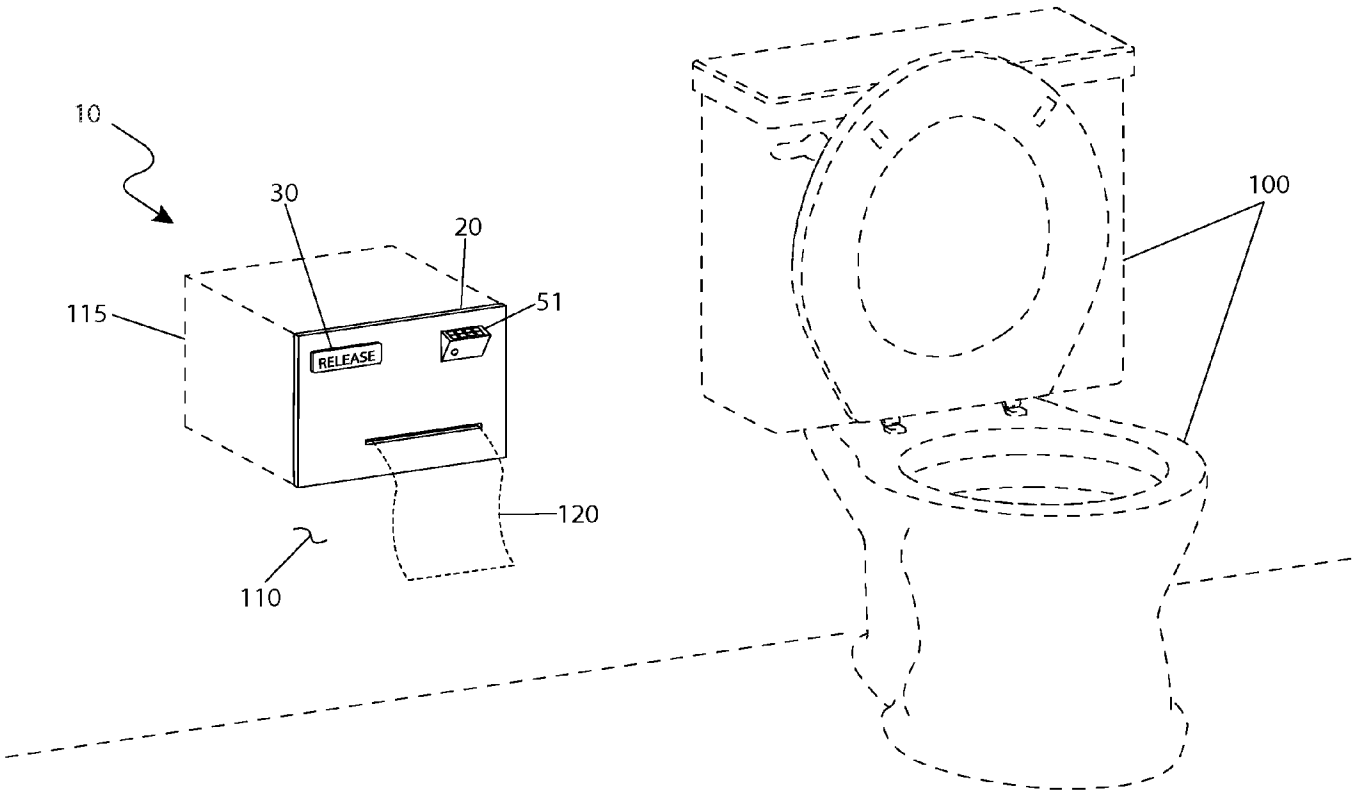
FIG. 1 is an environmental view of an electronic toilet tissue dispenser 10 depicting installation within a bathroom wall 110, according to a preferred embodiment of the present invention.

Referring now to FIG. 1, an environmental view of an electronic toilet tissue dispenser (herein described as the "apparatus") 10, depicting installation adjacent to an existing toilet 100 and within a bathroom wall 110 structure, according to a preferred embodiment of the present invention, is disclosed. The apparatus 10 provides a wall-mounted electronic toilet tissue dispenser which automatically releases a predetermined amount of toilet tissue 120 upon activation of a motion sensor 51 via a respective sensor beam 52. The apparatus 10 comprises a face plate 20 and an attached rectangular housing 35 envisioned to be made of injection-molded plastic. The apparatus 10 slides in and out of a wall cavity 115 in a drawer-like manner upon a pair of opposing ball-bearing-type tracks 37, 38 allowing access and replenishment of a standard roll of toilet tissue 120 stored within. Interruption of a sensor beam portion 52 of the sensor 51 provides activation and dispensing of the toilet tissue 120.

Figure 2:
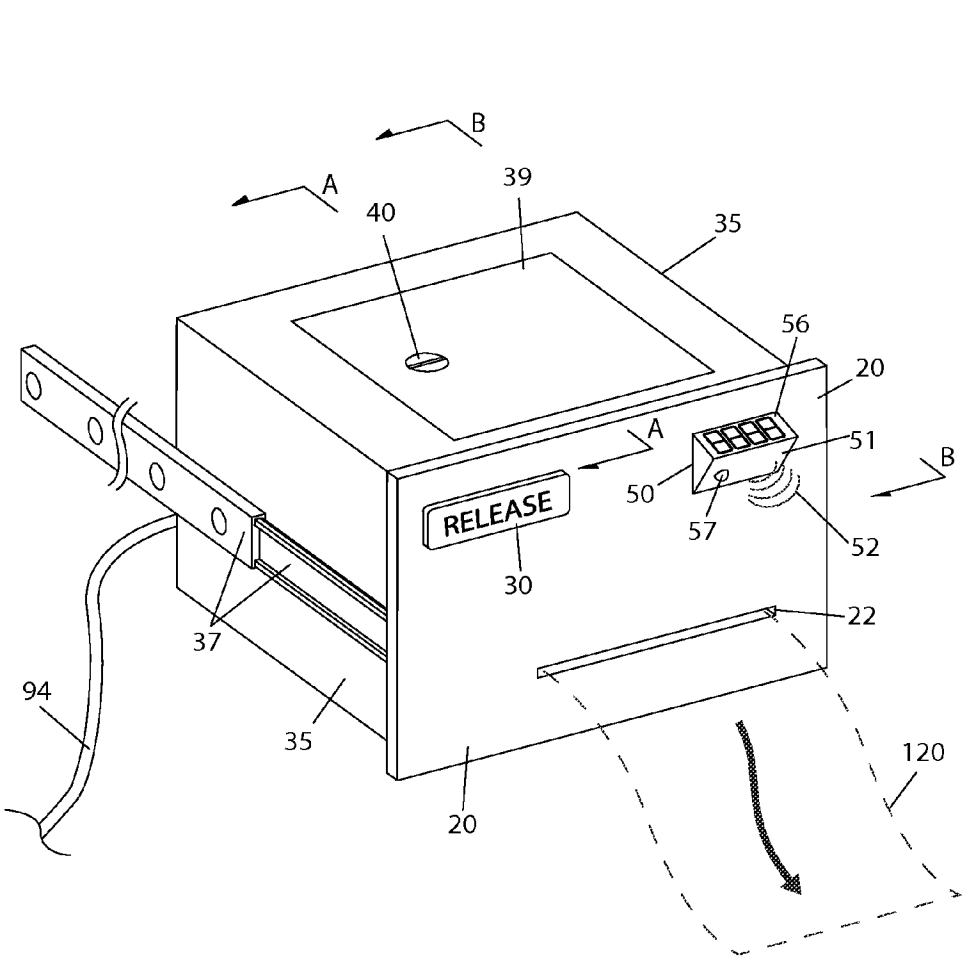
FIG. 2 is a perspective view of the electronic toilet tissue dispenser 10, according to a preferred embodiment of the present invention.

Referring now to FIG. 2, a perspective view of the apparatus 10, according to the preferred embodiment of the present invention, is disclosed. The apparatus 10 comprises a face plate 20, a rectangular housing 35, a first track 37, and a second track 38. The face plate 20 comprises a flat rectangular member which lies flat against a bathroom wall surface 110 and comprises a user interface feature to automatically dispense toilet tissue 120. The face plate 20 provides an attachment means to a sensor enclosure 50 which further comprises a sensor 51 and a digital display 56. The sensor 51 detects a presence of a user's hand, thereby activating the apparatus 10 and dispensing a length of toilet tissue 120 from a tissue dispensing slot 22 also located upon the face plate 20. The digital display 56 is envisioned to numerically display an approximate remaining number of sheets of tissue 120 within the apparatus 10. The digital display 56 is envisioned to provide a flashing mode to warn a user of a low level of toilet tissue 120 and a counter reset button 57.

The housing 35 extends rearwardly from the face plate 20 at a right angle, thereby protruding into the bathroom wall 110 (see FIG. 1). The housing 35 provides protective containment of electrical and electronic equipment necessary for the operation of the apparatus 10 as well as providing support of a roll of toilet tissue 120. The housing 35 provides access to the toilet tissue hub 33 along a top surface via a access cover 39 which is secured by a latch 40 and being of sufficient area to easily allow a user to replenish the roll of toilet tissue 120 (see FIG. 4).

The housing 35 is envisioned to be supported along inner portions of the bathroom wall 110 via the first 37 and second 38 track portions attached to a support structure within the wall portion 110. The tracks 37, 38 allow the housing 35 and face plate 20 portions to be extended from the bathroom wall portion 110, thereby allowing a user to replenish an internally contained roll of toilet tissue 120. The tracks 37, 38 comprise common commercially-available linear ball-bearing devices typically used to support common drawer structures (also see FIG. 4). The tracks 37, 38 comprise a matched pair being arranged in a parallel minor-image manner along opposite sides of the housing 35. Said tracks 37, 38 provide smooth linear motioning of the apparatus 10 and are envisioned to utilize common components such as, but not limited to: lowfriction ball bearings, TEFLON® sliders, and the like. The face plate 20 is affixed to the bathroom wall 110 via a face plate latch 32 which is actuated via a release push button 30 located upon an upper edge of the face plate 20, thereby allowing a user to release the face plate 20 from the wall 110 and extend the housing 35 outwardly to allow replenishment of said tissue 120.

Figure 3:
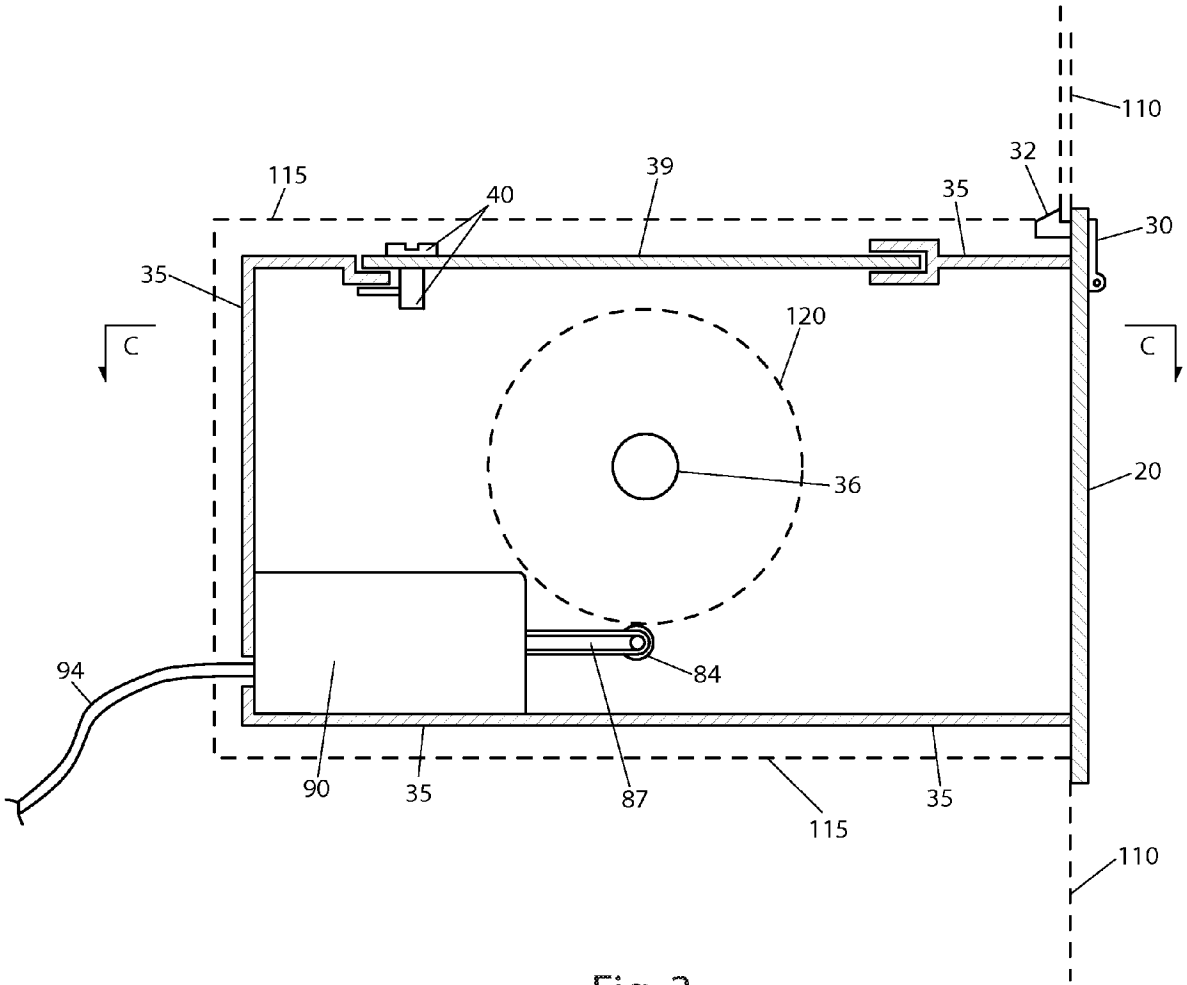
FIG. 3 is a section view of the electronic toilet tissue dispenser 10 taken along section line A-A (see FIG. 2), according to a preferred embodiment of the present invention.
Figure 4:
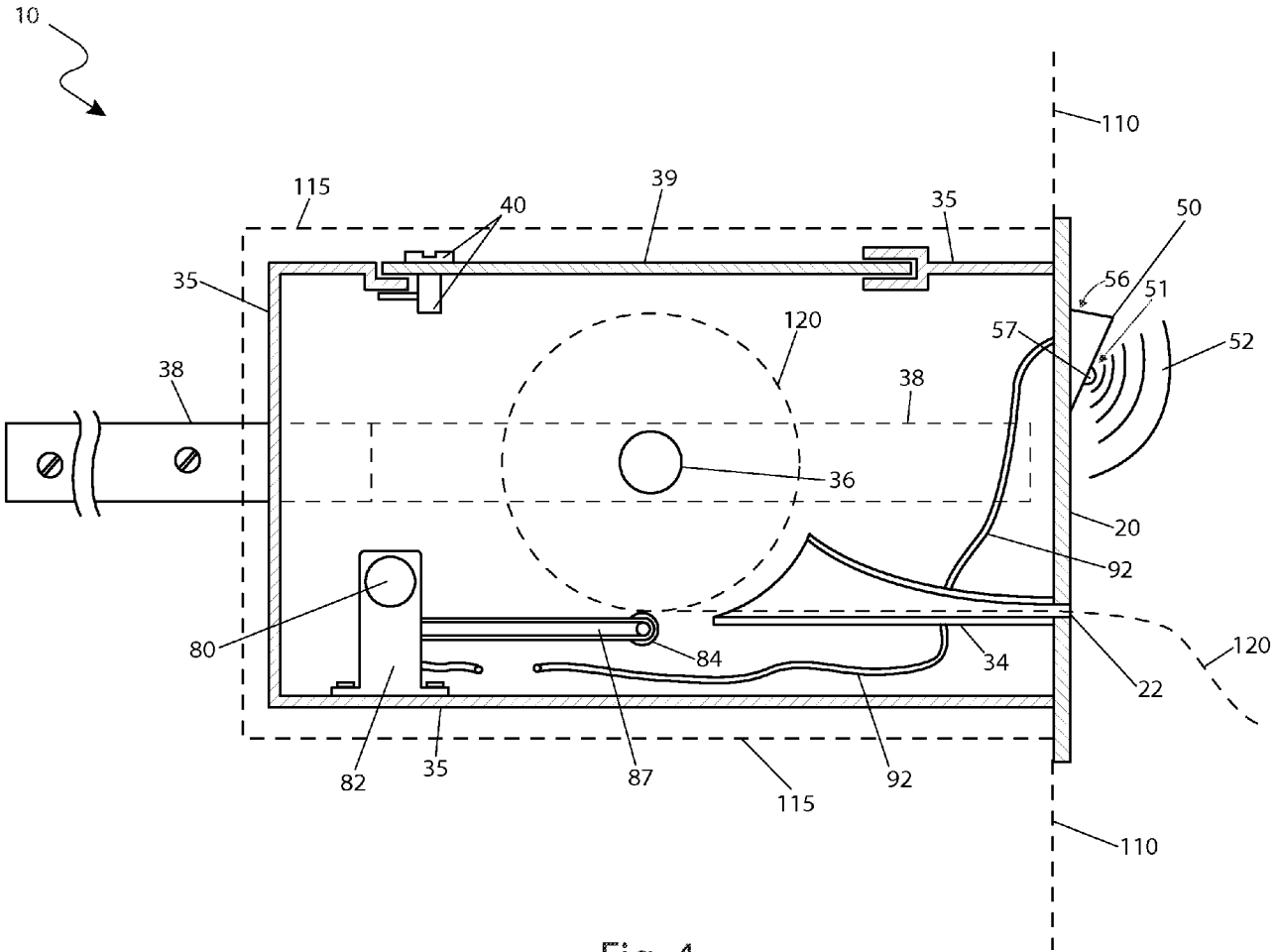
FIG. 4 is another section view of the electronic toilet tissue dispenser 10 taken along section line B-B (see FIG. 2), according to a preferred embodiment of the present invention.
Figure 5:
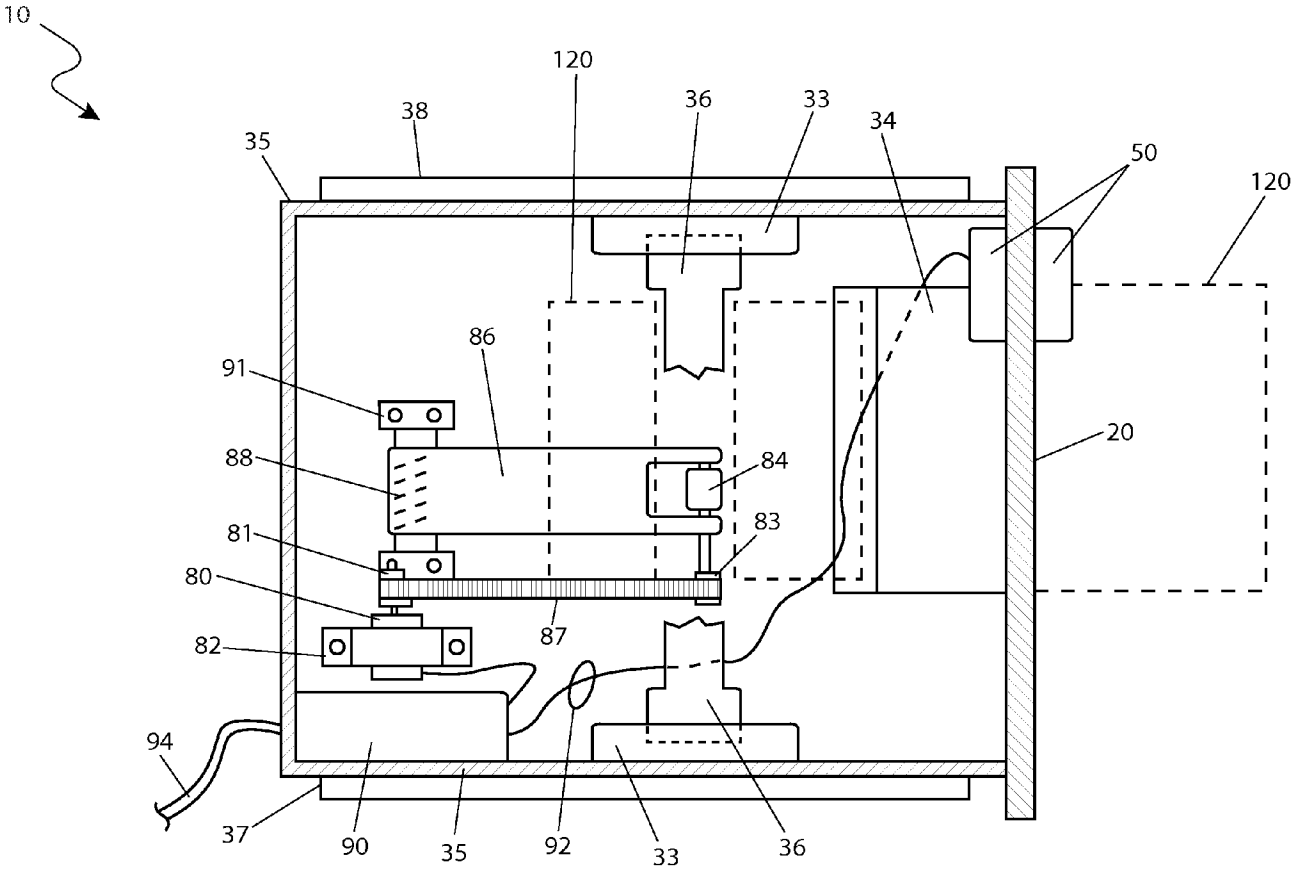
FIG. 5 is another section view of the electronic toilet tissue dispenser 10 taken along section line C-C (see FIG. 3), according to a preferred embodiment of the present invention; and, FIG. 6 is an electrical block diagram of the electronic toilet tissue dispenser 10, according to a preferred embodiment of the present invention.

Referring now to FIGS. 3, 4 and 5, section views of the apparatus 10 taken along section lines A-A, B-B, and C-C, respectively, according to a preferred embodiment of the present invention, are disclosed. Upon activation of the previously described sensor 51, the apparatus 10 provides automatic dispensing of a predetermined length of toilet tissue 120. The apparatus 10 comprises a tissue chute 34, a motor 80, a motor bracket 82, a drive roller 84, a drive arm 86, a drive belt 87, and a control box 90.

The housing 35 provides support of a roll of toilet tissue 120 upon an internal tissue hub 33 affixed to opposing inner side wall portions of said housing 35. The tissue hub 33 is envisioned to comprise a conventional spring-loaded cylindrical tissue roll holder 36 providing easy installation and removal of a roll of common toilet tissue 120 through the aforementioned access cover 39. The toilet tissue 120 is dispensed via a powered circumferential drive roller 84 which contacts and rotatingly motions a lower external surface of the roll of tissue 120. The drive roller 84 is powered by a motor 80 mounted to a floor portion of the housing 35 via a motor bracket 82. Said drive roller 84 is supported by a drive arm 86 which provides a spring-loaded force against said drive roller 84 and subsequently against the toilet tissue 120, via a torsion spring 88 which is integrated into a drive arm mounting bracket 91. Said drive arm mounting bracket 91 pivotingly anchors the drive arm 86 to the floor portion of the housing 35, thereby positioning the drive arm 86 and drive roller 84 in a cantilever manner beneath the roll of toilet tissue 120. Said motor 80 is in mechanical communication with said drive roller 84 via a drive belt 87. The motor 80 drives a first belt roller 81, which motions the belt 87 to force a second belt roller 83 being in mechanical communication with the drive roller 84. The drive roller 84 maintains rolling contact with an exterior surface of the toilet tissue roll 120, thereby propelling a length of toilet tissue 120 through a flat funnel-shaped tissue chute 34 which extends horizontally to the aforementioned tissue dispensing slot portion 22, allowing said toilet tissue 120 to protrude outwardly from the face plate 20 as seen in FIG. 4.

Figure 6:
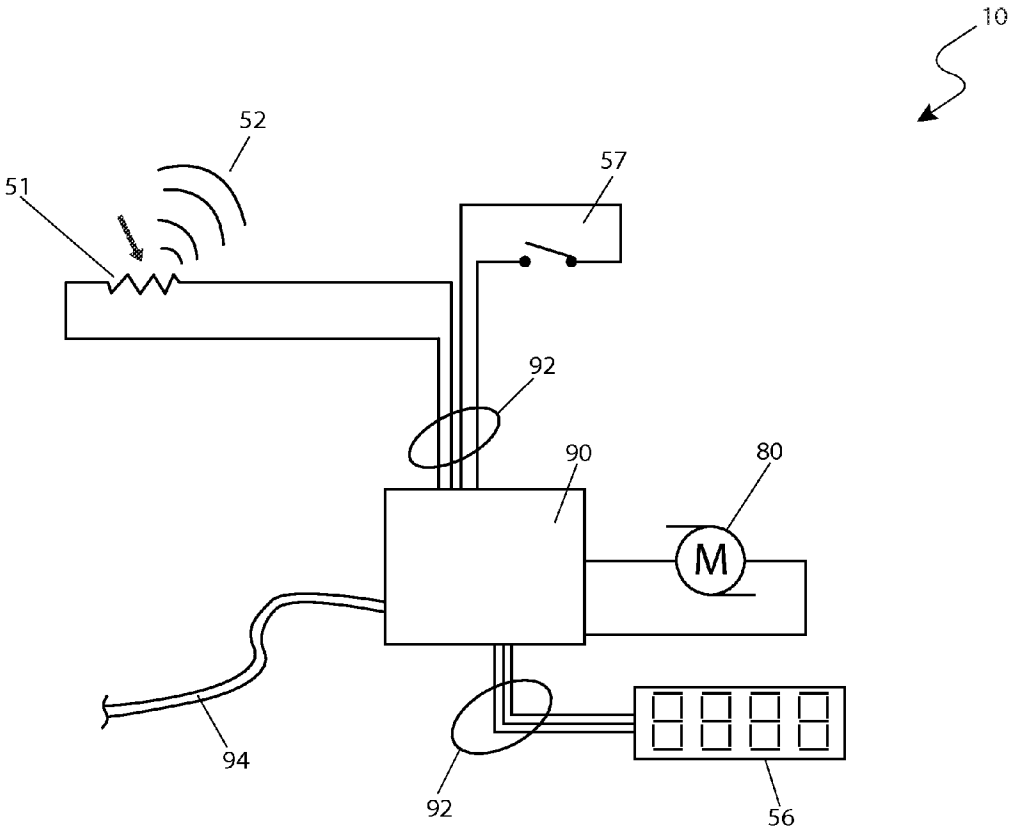

Referring now to FIG. 6, an electrical block diagram depicting the major electrical components of the apparatus 10, according to a preferred embodiment of the present invention, is disclosed. Electrical power is supplied to the apparatus 10 in a hard-wired manner from available 110-volt electrical supply wiring 94 within the bathroom wall 110. The power is in turn routed to a control box 90 within the housing 35. The control box 90 provides a protective enclosure to various electrical and electronic equipment necessary to operate the apparatus 10 such as, but not limited to; circuit boards, microprocessors, relays, embedded software, and the like. Input signals are routed to the control box 90 via common electrical wiring 92, from the sensor 51 to allow actuation of the tissue dispensing motor 80. The control box 90 is also envisioned to monitor and calculate a remaining amount of tissue 120 based upon a software counter which monitors accumulative cycling of the tissue dispensing motor 80, thereby providing a numerical display of a remaining approximate number of sheets of tissue 120 upon the digital display 56. The digital display 56 may be reset to zero upon pressing the reset button 57. Additionally, the control box 90 is also envisioned to cause the digital display 56 to display a flashing mode to warn a user of a low level of toilet tissue 120.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed within an existing stud wall as indicated in FIG. 1.

The method of installing the apparatus 10 may be achieved by performing the following steps: cutting and framing an appropriately sized wall cavity 115 into a bathroom wall 110 preferably adjacent to an existing toilet 100 at a desired location into which the apparatus 10 is to be installed; mounting the track portions 37, 38 to opposing side portions within the wall cavity 115; extending the housing 35 completely outwardly from the bathroom wall 110; connecting electrical supply wiring 94 to the apparatus 10 using conventional electrical connection methods; removing the access cover 39 using the latch 40; installing a new roll of toilet tissue 120 upon the tissue holder 36, then affixing the roll holder 36 with a mounted roll of toilet tissue 120 into the tissue hubs 33; manually feeding a length of tissue 120 through the tissue chute 34 until the tissue 120 protrudes from the tissue dispensing slot 22; replacing the access cover 39; and, pushing the housing 35 inwardly toward a surface of the bathroom wall 110 until the face plate 20 is flush to the wall 110 and the face plate latch 32 is securely engaged. The apparatus 10 is now ready to provide automatic toilet tissue 120 dispensing.

The method of utilizing the apparatus 10 may be achieved by performing the following steps: passing one's hand through the sensor beam 52 repeatedly until a desired length of toilet tissue 120 is dispensed; continuing to utilize the apparatus 10 until the digital display 56 flashes to indicate a low level of toilet tissue 120; replenishing the toilet tissue 120 by pressing the release button 30 to unlatch the face plate latch 32; manually motioning the apparatus 10 outwardly from the wall 110; removing the access cover 39 using the latch 40; installing a new roll of toilet tissue 120 upon the tissue hub 33 in a conventional manner; replacing the access cover 39; sliding the apparatus 10 against the bathroom wall 110 until the face plate 20 contacts said bathroom wall 110 and the face plate latch 32 is secured to said wall 110; manually motioning the apparatus 10 outwardly from the wall 110; securing the apparatus 10 to the wall 110 as described above; and, benefiting from automatic and efficient "hands-free" dispensing of toilet tissue 120 afforded a user of the present invention 10.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. An electronic toilet tissue dispenser for automatically releasing a predetermined amount of a toilet tissue roll, said electronic toilet tissue dispenser further comprising:

a housing adapted to contain the toilet tissue roll therein, comprising:

a motor located inside said housing;

a drive roller located inside said housing and powered by said motor, said drive roller adapted to contact and rotatingly motion a lower external surface of the toilet tissue roll;

a spring-loaded drive arm located inside said housing and engaged with said drive roller; and, a drive arm mounting bracket located inside said housing and anchored to a floor portion of said housing, said drive arm mounting bracket pivotingly anchoring said drive arm in a cantilever manner beneath the toilet tissue roll;

a control box located within said housing and connected to said motor; and, a sensor located exterior of said housing and being in communication with said control box;

wherein said sensor detects motion exterior of said housing and thereby notifies said control box to dispense a length of the toilet tissue roll from said housing.

2. The electronic toilet tissue dispenser of claim 1, wherein said housing further comprises:

a first belt roller located inside said housing and driven by said motor;

a second belt roller located inside said housing and being in mechanical communication with said drive roller; and, a drive belt located inside said housing and engaged with said first and second belt rollers.

3. The electronic toilet tissue dispenser of claim 2, wherein said housing further comprises:

an access cover situated at a top of said housing;

a latch adjustably attached to said face plate; and, a tissue chute attached to said face plate and located inside said housing;

wherein said drive roller is adapted to maintain rolling contact with an exterior surface of the toilet tissue roll thereby propelling a length of toilet tissue roll through said tissue chute and outwardly from said face plate.

4. The electronic toilet tissue dispenser of claim 3, wherein said housing further comprises: a digital display connected to said control box, said control box being capable of monitoring a cumulative cycling of said motor thereby providing a numerical display at said digital display of an approximate remaining number of sheets of the toilet tissue roll.

5. An electronic toilet tissue dispenser for automatically releasing a predetermined amount of a toilet tissue roll, said electronic toilet tissue dispenser further comprising:

a housing adapted to contain the toilet tissue roll therein, comprising:

a motor located inside said housing;

a drive roller located inside said housing and powered by said motor, said drive roller adapted to contact and rotatingly motion a lower external surface of the toilet tissue roll;

a spring-loaded drive arm located inside said housing and engaged with said drive roller; and, a drive arm mounting bracket located inside said housing and anchored to a floor portion of said housing, said drive arm mounting bracket pivotingly anchoring said drive arm in a cantilever manner beneath the toilet tissue roll;

a control box communicatively coupled to said motor of said housing; and, a sensor in communication with said control box;

wherein said sensor detects motion exterior of said housing and thereby notifies said control box to dispense a length of the toilet tissue roll from said housing.

6. The electronic toilet tissue dispenser of claim 5, wherein said housing further comprises:

a first belt roller located inside said housing and driven by said motor;

a second belt roller located inside said housing and being in mechanical communication with said drive roller; and, a drive belt located inside said housing and engaged with said first and second belt rollers.

7. The electronic toilet tissue dispenser of claim 6, wherein said housing further comprises:

an access cover situated at a top of said housing;

a latch adjustably attached to said face plate; and, a tissue chute attached to said face plate and located inside said housing;

wherein said drive roller is adapted to maintain rolling contact with an exterior surface of the toilet tissue roll thereby propelling a length of toilet tissue roll through said tissue chute and outwardly from said face plate.

8. The electronic toilet tissue dispenser of claim 7, wherein said housing further comprises: a digital display connected to said control box, said control box being capable of monitoring a cumulative cycling of said motor thereby providing a numerical display at said digital display of an approximate remaining number of sheets of the toilet tissue roll.

9. A method of utilizing an electronic toilet tissue dispenser for automatically releasing a predetermined amount of a toilet tissue roll, said method comprising the steps of:

providing a housing, comprising a motor, a drive roller powered by said motor, said drive roller adapted to contact and rotatingly motion a lower external surface of the toilet tissue roll, a spring-loaded drive arm engaged with said drive roller, and a drive arm mounting bracket anchored to a floor portion of said housing, said drive arm mounting bracket pivotingly anchoring said drive arm in a cantilever manner beneath the toilet tissue roll;

providing and containing a toilet tissue roll within said housing;

providing and communicatively coupling a control box to said motor of said housing;

providing and communicating a sensor with said control box;

said sensor detecting motion exterior of said housing and thereby notifying said control box; and, said control box dispensing a length of the toilet tissue roll from said housing.

* * * * *